US006042095A

United States Patent [19]

Kuchta et al.

[11] Patent Number: 6,042,095

[45] Date of Patent: Mar. 28, 2000

[54] METHOD AND APPARATUS FOR RETAINING ONE OR MORE LAYERS OF SHEET TYPE WORK MATERIAL ON A SUPPORT SURFACE

[75] Inventors: Richard Kuchta, Shickshinny, Pa.; Peter Hasiuk, Enfield; Joseph Vivirito, South Windsor, both of Conn.

[73] Assignee: Gerber Technology, Inc., Tolland, Conn.

[21] Appl. No.: 09/116,030

[22] Filed: Jul. 15, 1998

[51] Int. Cl.[7] ..... B25B 11/00

[52] U.S. Cl. ..... 269/21; 269/900

[58] Field of Search ..... 269/21, 900, 289 R

[56] References Cited

U.S. PATENT DOCUMENTS

| | | | |
|---|---|---|---|
| 3,495,492 | 2/1970 | Gerber et al. | 269/21 |
| 4,205,835 | 6/1980 | Gerber | 269/21 |
| 4,494,433 | 1/1985 | Gerber | 269/21 |
| 4,528,878 | 7/1985 | Gerber | 269/21 |
| 4,544,311 | 10/1985 | Husain | 269/21 |
| 4,587,873 | 5/1986 | Gerber | 269/21 |
| 4,685,363 | 8/1987 | Gerber | 269/21 |
| 4,723,766 | 2/1988 | Beeding | 269/21 |
| 4,984,960 | 1/1991 | Szarka | 269/21 |
| 5,171,398 | 12/1992 | Miyamoto | 269/21 |
| 5,207,140 | 5/1993 | Rosen | 269/21 |
| 5,410,791 | 5/1995 | Wirth et al. | 269/21 |
| 5,414,617 | 5/1995 | Pomerleau et al. | 269/21 |
| 5,553,837 | 9/1996 | Kahle | 269/21 |
| 5,899,445 | 5/1999 | Kimble | 269/21 |

*Primary Examiner*—James G. Smith
*Assistant Examiner*—Lee Wilson
*Attorney, Agent, or Firm*—McCormick, Paulding & Huber LLP

[57] ABSTRACT

In an apparatus for retaining one or more layers of sheet type work material on a permeable support surface, at least two vacuum manifolds are positioned under the support surface, each defining at least one vacuum inlet for drawing vacuum therethrough. Proportional control valves are coupled to the manifolds for selectively controlling the location and intensity of the vacuum being drawn, such that work material positioned on the support surface is held thereto by the vacuum drawn through the inlets and the support surface. The intensity of the vacuum is selectively controlled by the valves to concentrate vacuum in the area along the work material where a work operation is being performed.

16 Claims, 3 Drawing Sheets

METHOD AND APPARATUS FOR RETAINING ONE OR MORE LAYERS OF SHEET TYPE WORK MATERIAL ON A SUPPORT SURFACE

FIELD OF THE INVENTION

The present invention relates generally to devices for performing work operations on one or more layers of sheet-type work material, and deals more particularly with an apparatus and method for retaining the work material on a support surface via vacuum selectively drawn through two or more manifolds.

BACKGROUND OF THE INVENTION

Work operations are often performed on multiple layers of sheet-type work material, for example, in the mass production of garments, pattern pieces are usually cut from multiple layers of fabric spread one-on-top-of-the-other on a support surface. To facilitate clean accurate cuts, the layers of work material, often referred to as a lay, must be adequately held in place on the support surface during the performance of a cutting operation. Failure to do so can result in movement of the fabric layers relative to one another, detrimentally affecting the performance of the cutting operation.

Generally, pattern pieces are cut from the lay using what is referred to as a cutter table that usually includes a permeable, often conveyorized, cutting surface and a moveable cutter head that traverses the support surface, cutting pattern pieces from the layers of material in response to commands issued from a controller. To eliminate any undesired movement of the layers of work material during the performance of a work operation, vacuum is sometimes used in an effort to draw the work material against the support surface. In prior art cutter tables this was usually accomplished via a single centrally located vacuum manifold positioned under the permeable support surface and defining one or more inlets through which vacuum is drawn.

A difficulty sometimes encountered when a single centrally located vacuum manifold is employed, is that the portions of the work material located remotely from the manifold tend to be inadequately retained by the vacuum. This inadequate retention can result in movement of the work material during the performance of a work operation, and the generation of inaccurately cut pattern pieces. This problem is further exacerbated as the cutter tables increase in width.

In the past, efforts to address the above-described problems have failed. In one proposed solution, the inlets in the centrally located manifold were enlarged to increase the vacuum drawn there through. However, the enlarged inlets weakened the vacuum manifold to such an extent that it deformed during operation.

Another proposed solution was to increase the intensity of the vacuum drawn through the inlets. However, in cutting tables where the support surface was conveyorized and movable relative to the frame, the increased vacuum concentration caused the support surface to be drawn against the vacuum manifold, thereby hindering the movement of the support surface relative to the manifold.

Based on the foregoing, it is the general object of the present invention to provide an apparatus and method for retaining multiple layers of sheet material against a support surface that overcomes the drawbacks of prior art methods and apparatus for retaining sheet material.

It is a more specific object of the present invention to provide a method and apparatus which applies vacuum to the layers of sheet material adjacent to the location of the performance of a work operation.

SUMMARY OF THE INVENTION

The present invention is directed to an apparatus for retaining one or more layers of sheet type work material on a support surface that is permeable and coupled to a frame. At least two vacuum manifolds are coupled to the frame and spaced apart from one another, each defining at least one vacuum inlet through which a vacuum means draws vacuum through the permeable support surface to retain the work material thereon. This prevents any undesired movement of the work material relative to the support surface during the performance of a work operation.

The present invention also includes means for selectively regulating the vacuum drawn through the inlets in each of the manifolds in an effort to concentrate vacuum at particular locations along the support surface. Preferably these means include a plurality of butterfly valves positioned within, and pivotally coupled to vacuum conduits that extend between the vacuum means and the vacuum manifold, adjacent to each of the inlets. Each of the butterfly valves is moveable between an open position, wherein vacuum can be freely drawn through the vacuum inlets; and a closed position, wherein vacuum is prevented from being drawn through the vacuum inlets.

In a preferred embodiment of the present invention, pneumatic cylinders are coupled to each of the butterfly valves as well as to the frame to move the butterfly valves between the open and the closed positions in response to commands issued from the controller. While butterfly valves have been described, the present invention is not limited in this regard as other valves, such as ball and gate valves, can be substituted without departing from the broader aspects of the present invention. In addition, while a pneumatic cylinder has been described, the present invention is not limited in this regard as other actuators, such as, hydraulic cylinders, stepper motors, or servos can be substituted without departing from the broader aspects of the invention.

The present invention also resides in a method for retaining one or more layers of sheet type work material on a support surface that employs the above-described apparatus. Prior to the performance of a work operation, vacuum is selectively drawn through the inlets defined by the manifolds in response to commands issued from the controller, thereby retaining the work material against the support surface and preventing any undesired movement of the work material relative to the support surface. During the performance of the work operation, the intensity of the vacuum drawn through the manifolds is adjusted proportionally, relative to the inlets defined by the manifolds, as well as to the manifolds themselves, to concentrate vacuum in the area adjacent to where the work operation is being performed.

DETAILED DESCRIPTION OF THE PREFERRED EMBODIMENT

Figure 1:
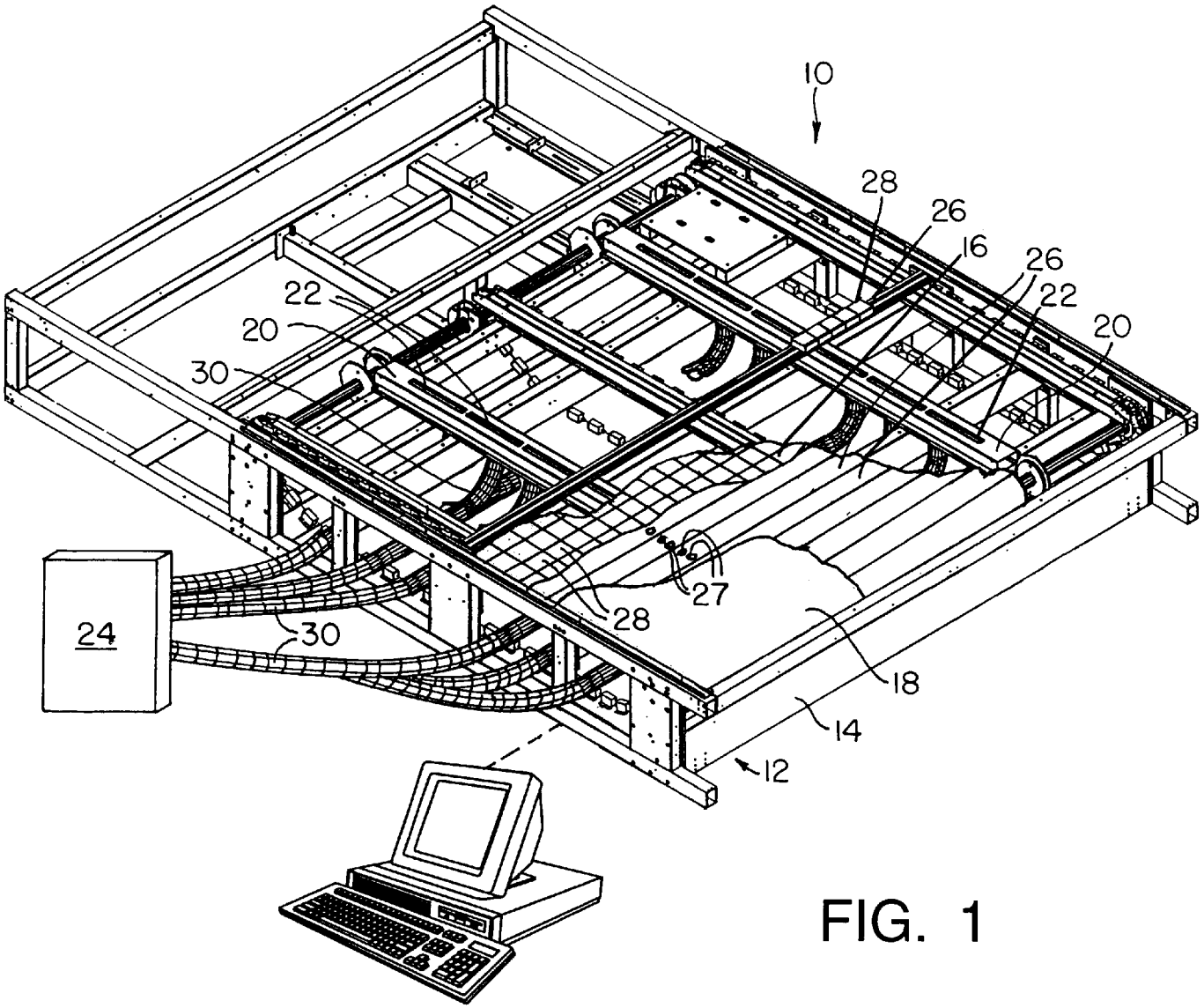
FIG. 1, is a partial perspective view of a cutter table embodying the apparatus of the present invention showing a support surface comprised in-part by a plurality of consecutive slats; the support surface being cut away to show a pair of vacuum manifolds each defining a plurality of vacuum inlets.

As shown in FIG. 1, an apparatus for retaining one or more layers of sheet type work material on a support surface is indicated generally by the reference numeral 10. The apparatus 10 is shown in the illustrated embodiment as a cutter table 12, and includes a frame 14 having a permeable support surface 16 mounted thereon, for carrying one or more layers of sheet-type work material 18. Two vacuum manifolds 20, each defining a plurality of vacuum inlets 22 are mounted to the frame 14, below and adjacent to the support surface 16. The vacuum manifolds 20 are spaced apart relative to one another and extend longitudinally of the frame 14. Vacuum is drawn through the vacuum manifolds by suitable means, such as, but not limited to a vacuum pump 24.

Still referring to FIG. 1, the permeable support surface 16 is comprised of a plurality of slats 26 each overlying and being supported by the vacuum manifolds 20 and extending transversely across the frame 14. The slats 26 are linked together to collectively define the support surface 16. The slats 26 are movable in a direction longitudinal of the frame 14 by a suitable drive, such as a motor (not shown) in response to commands issued from the controller. Each slat 26 defines at least two apertures 27 extending therethrough, making the slat permeable, thereby allowing vacuum to be drawn through the support surface 16. A plurality of bristle blocks 28 are attached to each of the slats, each defining a plurality of upstanding bristles for supporting the work material 18 positioned thereon.

Figure 2:
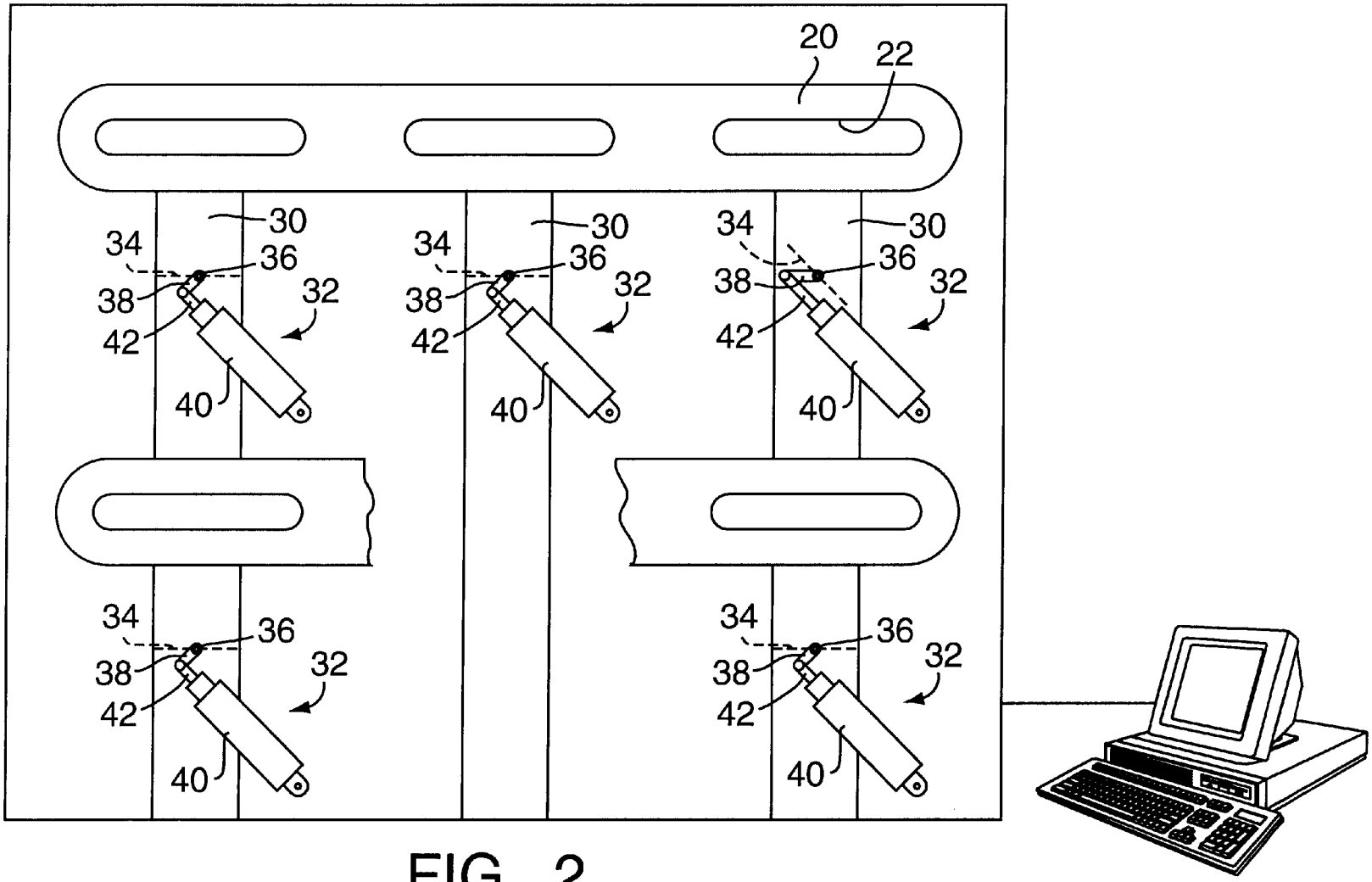
FIG. 2 is a partial simplified schematic of the vacuum manifolds and the proportional control valves of the apparatus shown in FIG. 1.

As shown in FIG. 1, and illustrated schematically in FIG. 2, a plurality of conduits 30 are coupled at one end to the vacuum pump 24 and at an opposite to each of the vacuum manifolds 20 adjacent to the vacuum inlets 22. A proportional control valve assembly 32 is coupled to each conduit 26, between the vacuum pump 24 and the manifolds 20, for controlling the amount of vacuum drawn through a particular conduit.

Referring specifically to FIG. 2 the proportional control valve assemblies 32 illustrated therein, each include a butterfly valve 34 (shown in dotted lines) positioned in, and pivotally coupled to each conduit 30. The butterfly valves 34 are moveable between an open position where vacuum can be freely drawn through the associated conduit 30, and a dosed position where vacuum is prevented from being drawn through the conduit.

A portion 36 of each butterfly valve 34 extends from each conduit 30 and is attached to a link 38. The link 38 is in turn coupled to a suitable actuator 40, such as a pneumatic cylinder, having a rod 42 pivotally coupled to the link 38 and movable between an extended and retracted position to move the associated butterfly valve 34 between the open and closed positions, in response to commands issued from the controller.

While butterfly valves have been shown and described, the present invention is not limited in this regard as other types of valves known to those skilled in the pertinent art to which the invention pertains, such as, but not limited to ball, and gate valves may be substituted without departing from the broader aspects of the present invention. In addition, while the actuators 40 have been shown and described as pneumatic cylinders, the present invention is not limited in this regard as other types of actuators, such as, but not limited to stepper motors, servos, or hydraulic cylinders may be substituted without departing from the broader aspects of the present invention.

Figure 3:
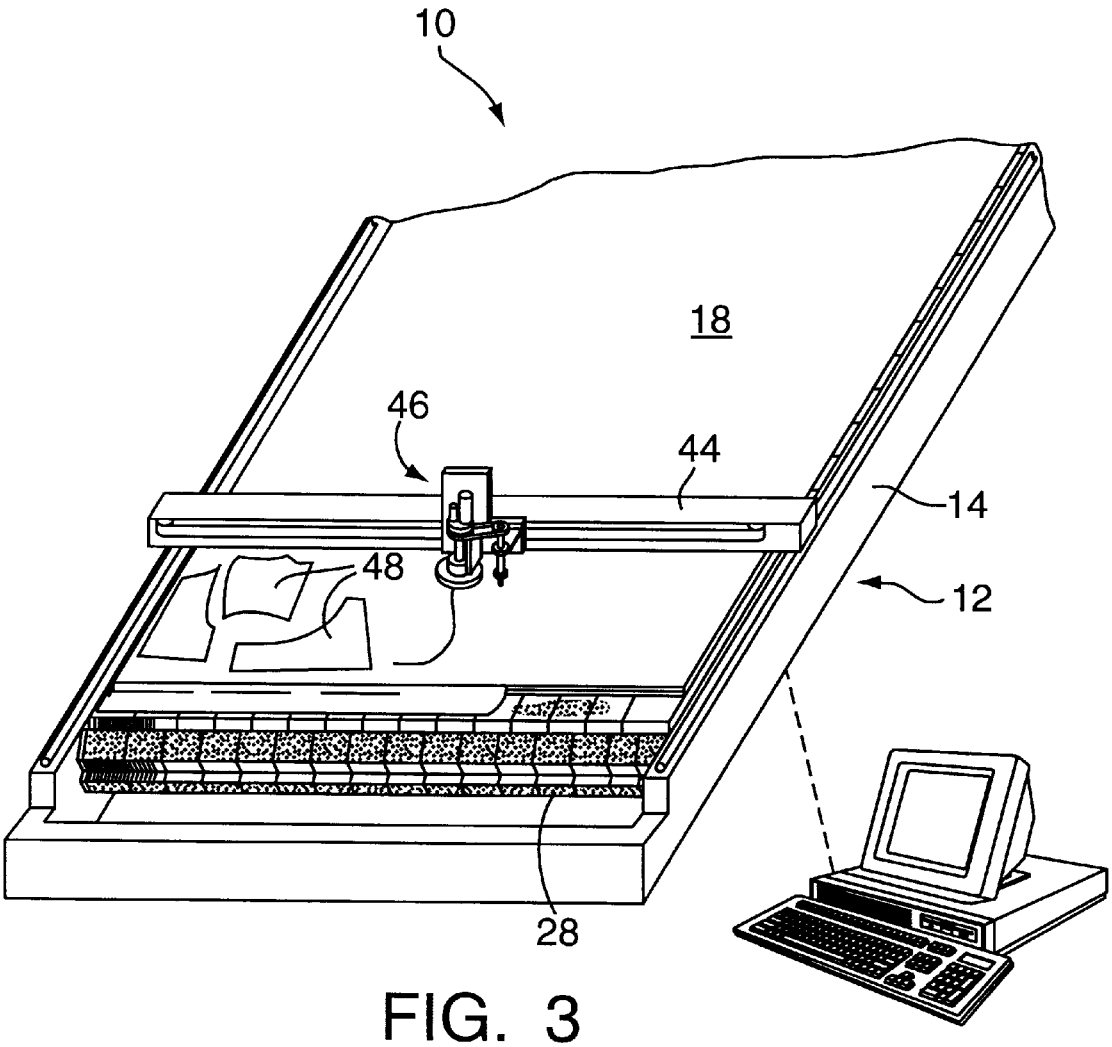
FIG. 3 is a partial perspective view of the cutter table of FIG. 1.

As shown in FIG. 3, the cutter table 12 includes a support 44 mounted on the frame 14 for movement back-and-forth longitudinally of the cutter table in response to commands issued from the controller. A cutter head 46 is mounted to the support 44 for movement back-and-forth longitudinally of the support and transversely of the frame 14, also in response to commands issued from the controller. A cutting implement, such as, but not limited to a blade (not shown) is mounted to the cutter head and engages the work material 18 during the performance of a cutting operation, to cut pattern pieces 48 from the work material.

Referring to FIGS. 1–3, during operation, one or more layers of work material 18 are positioned on the permeable support surface 16. Vacuum is drawn through the inlets 22 defined by the manifolds 20, by energizing the vacuum pump 24 and selectively actuating the pneumatic cylinders 40 to move the butterfly valves 34 between the open and the closed positions in response to commands issued from the controller. The vacuum draws the work material 18 against the support surface 16, preventing any undesired movement of the work material 18. The support 44, and the cutter head 46 then move over the work material, cutting pattern pieces 48 therefrom. As the pattern pieces 48 are being cut, the controller issues commands to the pneumatic cylinders 40, causing them to move the valves 34 between the open and closed positions to vary the intensity of the vacuum relative to the inlets 22 and the manifolds 20. This concentrates the vacuum in the area adjacent to where the work operation is being performed to ensure that no undesired work material motion occurs which could detrimentally affect the integrity of the cut pattern pieces 48.

While preferred embodiments have been shown and described, various modifications and substitutions may be made without departing from the spirit and scope of the present invention. Accordingly, it is to be understood that the present invention has been described by way of example, and not by limitation.

What is claimed is:

1. An apparatus for retaining one or more layers of sheet type work material on a support surface, comprising:

a frame;

a permeable support surface coupled to said frame for carrying at least one layer of sheet type work material;

a controller in communication with said apparatus for storing data in machine readable format corresponding to a work operation to be performed on said work material;

at least two vacuum manifolds coupled to said frame and spaced apart relative to each other, each of said manifolds defining at least one vacuum inlet;

means for drawing vacuum through said inlets and said permeable support surface; and means for proportionally adjusting the vacuum drawn through said inlets in each of said manifolds relative to one another to concentrate vacuum at particular locations along said support surface in response to commands issued from said controller.

2. An apparatus for retaining one or more layers of sheet type work material on a support surface as defined by claim 1, further comprising means for individually controlling the amount of vacuum drawn through each inlet, in response to commands issued from said controller.

3. An apparatus for retaining one or more layers of sheet type work material on a support surface as defined by claim 2, wherein said means for controlling the amount of vacuum drawn through each inlet includes a plurality of proportional control valves, each coupled to one of said inlets and movable in response to commands issued from said controller, such that each between an open position, wherein vacuum can be freely drawn through said inlets, and a closed position, wherein vacuum is prevented from being drawn through said inlets.

4. An apparatus for retaining one or more layers of sheet type work material on a support surface as defined by claim 3, further comprising:

a plurality of vacuum conduits, each coupled to one of said manifolds adjacent to one of said inlets; and each of said plurality of proportional control valves being a butterfly valve positioned within and pivotally coupled to one of said conduits for movement between the open and closed positions.

5. An apparatus for retaining one or more layers of sheet type work material on a support surface as defined by claim 3, further comprising:

a plurality of vacuum conduits, each coupled to one of said manifolds adjacent to one of said inlets; and each of said plurality of proportional control valves being a ball valve coupled to one of said conduits for movement between the open and closed positions.

6. An apparatus for retaining one or more layers of sheet type work material on a support surface as defined by claim 3, further comprising:

a plurality of vacuum conduits, each coupled to one of said manifolds adjacent to one of said inlets; and each of said plurality of proportional control valves being a gate valve coupled to one of said conduits for movement between the open and closed positions.

7. An apparatus for retaining one or more layers of sheet type work material on a support surface as defined by claim 3, further comprising a plurality of actuators each coupled to one of said proportional control valves for moving said valve between said open position and said closed position in response to commands issued from said controller.

8. An apparatus for retaining one or more layers of sheet type work material on a support surface as defined by claim 7, wherein each of said plurality of actuators is a pneumatic cylinder, pivotally coupled to one of said proportional control valves.

9. An apparatus for retaining one or more layers of sheet type work material on a support surface as defined by claim 7, wherein each of said plurality of actuators is a stepper motor, coupled to one of said proportional control valves.

10. An apparatus for retaining one or more layers of sheet type work material on a support surface as defined by claim 7, wherein each of said plurality of actuators is a solenoid, coupled to one of said proportional control valves.

11. An apparatus for retaining one or more layers of sheet type work material on a support surface as defined by claim 7, wherein each of said plurality of actuators is a servo, coupled to one of said proportional control valves.

12. An apparatus for retaining one or more layers of sheet type work material on a support surface as defined by claim 1, wherein:

said permeable support surface is defined by a plurality of slats arranged in succession and coupled together, said slats overlaying and being partially supported by each of said manifolds; and means for moving said plurality of slats in a direction longitudinal of said frame.

13. An apparatus for retaining one or more layers of sheet type work material on a support surface as defined by claim 1, wherein said means for drawing vacuum through said inlets and said permeable support surface includes a vacuum pump.

14. A method for retaining one or more layers of sheet type work material on a support surface comprising the steps of:

providing an apparatus having a permeable support surface coupled to a frame, a controller in communication with the apparatus for storing data in machine readable format corresponding to a work operation to be performed on said work material, at least two vacuum manifolds coupled to said frame and spaced apart relative to each other, each of said manifolds defining at least one vacuum inlet, and means for drawing vacuum through said inlets and said permeable support surface;

providing at least one layer of sheet type work material positioned on said support surface;

drawing vacuum through said inlets and said manifolds in response to commands issued from said controller to retain said sheet type work material on said support surface;

performing a work operation on said work material in response to commands issued from said controller; and proportionally adjusting the intensity of the vacuum in response to commands issued from said controller, relative to the inlets, as well as to each manifold, such that during the performance of said work operation the intensity of the vacuum is greatest in the area adjacent to where said work operation is being performed.

15. A method for retaining one or more layers of sheet type work material on a support surface as defined by claim 14, wherein:

said apparatus further includes a plurality of vacuum conduits, each coupled to one of said manifolds adjacent to one of said inlets, a plurality of butterfly valves, each positioned within and pivotally coupled to one of said conduits for movement between an open position, wherein vacuum can be freely drawn through said conduit, and a closed position, wherein vacuum is prevented from being drawn through said conduit, and a plurality of pneumatic cylinders, each pivotally coupled at one end to said frame and at an opposed end to one of said proportional control valves; and wherein wherein said step of proportionally adjusting the intensity of the vacuum further includes selectively actuating said pneumatic cylinders to move at least one of said butterfly valves between said open position and said closed position, thereby regulating the intensity of vacuum at said manifolds and said inlets in response to commands issued from said controller.

16. A method for retaining one or more layers of sheet type work material on a support surface as defined by claim 14, wherein:

said permeable support surface is defined by a plurality of slats arranged in succession and coupled together, said slats overlaying and being partially supported by each of said manifolds; and said method includes the further step of moving said plurality of slats in a direction longitudinal of said frame, such that said plurality of slats convey said work material onto or off of said support surface in response to commands issued from said controller.

* * * * *